US009751734B1

(12) United States Patent
Boger

(10) Patent No.: US 9,751,734 B1
(45) Date of Patent: Sep. 5, 2017

(54) GRAPPLER OVERLOAD PROTECTION

(71) Applicant: Altec Industries, Inc., Birmingham, AL (US)

(72) Inventor: David K. Boger, Sonoma, CA (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 15/397,322

(22) Filed: Jan. 3, 2017

(51) Int. Cl.

| | |
|---|---|
| ***B66C 23/90*** | (2006.01) |
| ***B66C 13/16*** | (2006.01) |
| ***B66C 13/18*** | (2006.01) |
| ***B66C 15/00*** | (2006.01) |
| ***B66C 15/06*** | (2006.01) |
| *B66C 1/44* | (2006.01) |

(52) U.S. Cl.
CPC ..... *B66C 23/90* (2013.01); *B66C 13/16* (2013.01); *B66C 13/18* (2013.01); *B66C 15/00* (2013.01); *B66C 15/06* (2013.01); *B66C 1/44* (2013.01)

(58) Field of Classification Search
None
See application file for complete search history.

(56) References Cited

U.S. PATENT DOCUMENTS 4,546,891 A * 10/1985 Lanigan, Sr. ..... B66C 19/007 212/327
4,614,274 A * 9/1986 LaValle ..... B66F 9/07 212/285
4,715,762 A * 12/1987 Lanigan, Sr. ..... B66C 19/007 212/324
5,094,581 A * 3/1992 Lamb ..... A01D 87/0076 37/405
5,957,650 A * 9/1999 Rollo ..... E02F 3/404 37/406
6,021,911 A * 2/2000 Glickman ..... B66C 13/06 212/274
6,098,320 A * 8/2000 Wass ..... A01D 87/00 37/406
6,176,531 B1 * 1/2001 Wheeler ..... B66C 3/16 294/104
6,286,696 B1 * 9/2001 Van Gorp ..... B66C 19/007 212/343

(Continued)

FOREIGN PATENT DOCUMENTS

| | | |
|---|---|---|
| CN | 202146806 U | 2/2012 |
| EP | 2399674 A2 | 12/2011 |

*Primary Examiner* — Russell Frejd
(74) *Attorney, Agent, or Firm* — Erise IP, P.A.

(57) ABSTRACT

A grappler overload protection system uses a load-measuring device to provide a first load indication for preventing the grappler from bearing an unsafe load when the first load indication exceeds a first limit. A grappler overload protection method determines a spread of grappler arms based on information from a first sensor, determines an expected weight of the load based on the spread of the grappler arms, and compares the expected weight to a first limit for preventing the grappler from bearing an unsafe load. The method may optionally determine an angle of a boom supporting the grappler for determining an expected torque on the boom based on the boom angle and the expected weight of the load. The method may take preventative measures to prevent the grappler from bearing the load when the expected weight exceeds the first limit or when the expected torque exceeds a second limit.

20 Claims, 7 Drawing Sheets

(56) References Cited

U.S. PATENT DOCUMENTS

| | | | | |
|---|---|---|---|---|
| 6,601,891 | B1 * | 8/2003 | Gregory, Jr. | B66C 1/585 294/104 |
| 6,640,986 | B2 * | 11/2003 | Zakula, Sr. | B66C 19/007 212/273 |
| 8,511,593 | B2 | 8/2013 | Romanovich | |
| 2003/0168872 | A1 * | 9/2003 | Zakula, Sr. | B66C 1/30 294/81.51 |
| 2005/0066641 | A1 * | 3/2005 | Huhmarkangas | B60P 3/41 56/1 |
| 2006/0102578 | A1 * | 5/2006 | Zakula, Sr. | B66C 13/22 212/283 |
| 2007/0059148 | A1 * | 3/2007 | Westendorf | E02F 3/404 414/729 |
| 2012/0074079 | A1 * | 3/2012 | Marley | F24J 2/5232 211/41.1 |
| 2012/0308055 | A1 * | 12/2012 | Moler | H02N 2/043 381/190 |
| 2013/0292190 | A1 * | 11/2013 | Havimaki | A01G 23/00 177/1 |
| 2015/0148962 | A1 * | 5/2015 | Schwarzhans | B66C 13/16 700/275 |
| 2016/0009325 | A1 * | 1/2016 | Perkins | B62D 65/18 212/171 |
| 2016/0116328 | A1 * | 4/2016 | Kivi | B66C 13/16 702/101 |

* cited by examiner

GRAPPLER OVERLOAD PROTECTION

BACKGROUND

1. Field

Embodiments of this disclosure relate generally to safety systems for use with various other systems. More specifically, embodiments of this disclosure relate to systems for establishing and enforcing safe operating limits associated with a load.

2. Related Art

Various safety-limit systems provide operation of a device under certain conditions deemed to be safe. For example, door interlocks installed in elevators prevent the door from opening when the elevator car is more than a certain distance from the floor. Other large-machinery equipment also employs various safety systems.

SUMMARY

Embodiments of this disclosure provide a grappler overload protection system. The grappler overload protection system includes at least one sensor that provides information to a controller about a current load level associated with a device such as an aerial device. The controller determines if a load limit has been reached and prevents further operation of the device until the load is decreased below the limit. A signal or other indication may be provided to alert a user of the device that a load limit has been reached. The load-limit safety system enables a user to avoid unsafe situations that may otherwise damage equipment or harm personnel.

A first embodiment is directed to a grappler overload protection system. The system includes a grappler having at least two arms for gripping a load; a first sensor for providing a first load indication based on a position of the at least two arms while gripping the load; and, a controller configured to determine whether the first load indication exceeds a first limit for preventing the grappler from bearing an unsafe load. A second embodiment is directed to a grappler overload protection method. The method includes placing grappler arms about a load; determining a spread of the grappler arms based on information from a first sensor; estimating an expected weight of the load based on the spread of the grappler arms; and, comparing the expected weight to a first limit to prevent the grappler from bearing an unsafe load.

A third embodiment is directed to a non-transitory computer readable medium having a computer program stored thereon for providing grappler overload protection, including determining a spread of grappler arms placed about a load, wherein the spread is based on information from a first sensor; estimating an expected weight of the load based on the spread information from the first sensor; and, comparing the expected weight to a first limit for preventing the grappler from bearing an unsafe load.

Another embodiment may be directed to an aerial device, including a base, a boom, and a grappler overload protection system. Still another embodiment may be directed to a grappler, including grappler arms connected to a moveable arm or boom, and a grappler overload protection system. Yet another embodiment may be directed to a tree-trimming device including grappler arms for grabbing a tree limb and shearing blades for cutting the tree limb, with the grappler arms and shearing blades mechanically coupled to a telescoping, angling, and rotating boom for positioning the grappler arms and shearing blades to trim tree limbs. Yet a further embodiment may be directed to a vehicle, including a boom and a grappler overload protection system. Other embodiments will also be discussed throughout the present disclosure.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages will be apparent from the following detailed description of the embodiments and the accompanying drawing figures.

BRIEF DESCRIPTION OF THE DRAWING FIGURES

Embodiments of this disclosure are described in detail below with reference to the attached drawing figures, wherein.

Figure 1:
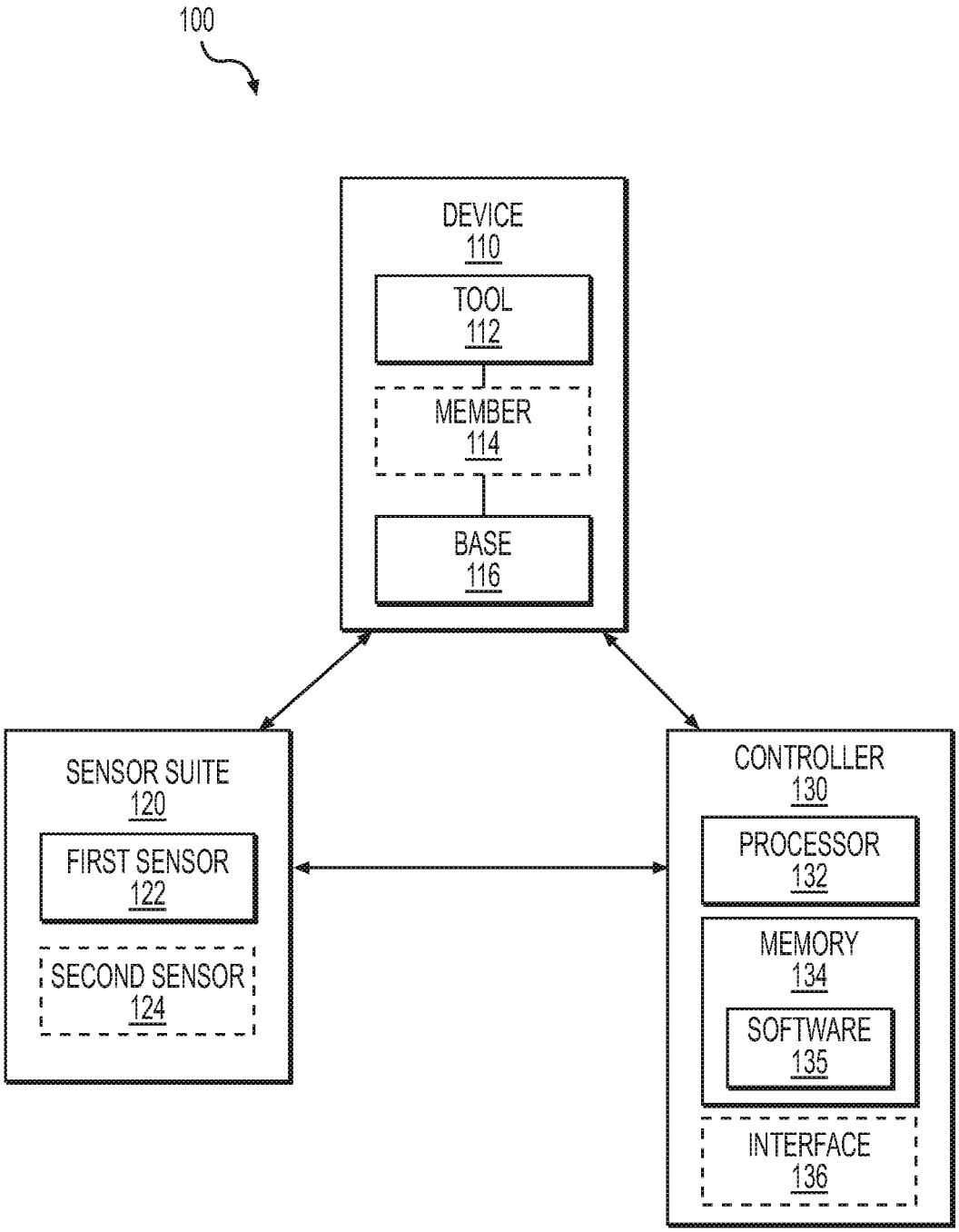
FIG. 1 is a block diagram illustrating an overload protection system, in an embodiment.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

An overload protection system 100 is configured to be utilized in conjunction with a device 110, as illustrated in FIG. 1. In certain embodiments, the overload protection system 100 comprises a device 110, a sensor suite 120 having one or more sensors, and a controller 130. The device 110 may be used to grab, hold, or suspend an object, such that the weight of the object applies a load to the device 110. Excessive loads (in magnitude and/or duration) may cause damage to the device 110 or its components. Excessive loads may also risk harming an operator of the device 110. Therefore, determining situations that are likely to cause excessive loads before they are applied to the device 110 may reduce or prevent damage or harm.

Figure 4:
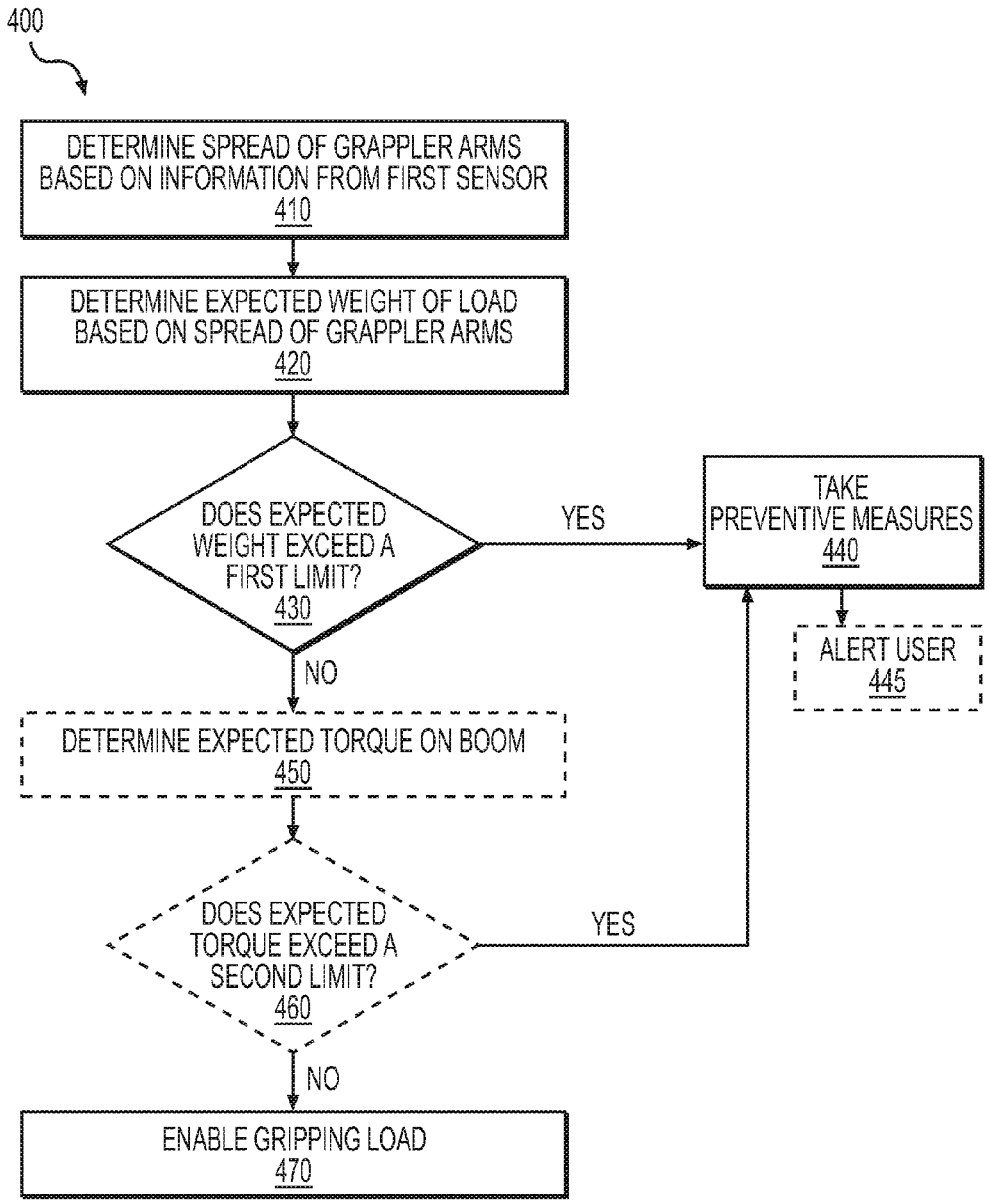
FIG. 4 is a flow diagram illustrating steps of a method of providing grappler overload protection, in an embodiment.

The load may be any object having weight that is suspended from or otherwise applied to a component of the device 110. For example, the load may be held by a grappler or suspended from a boom of the device 110. The sensor suite 120 sends information indicative of a measurement to the controller 130. The controller 130 determines an expected load on the device 110 based on the information received from the sensor suite 120. Based upon the expected load, and at least one predetermined load limit, the controller 130 determines whether to take preventative action (e.g., disable operation of the device 110 or one of its components) to prevent the device 110 from bearing an unsafe load. The steps of an exemplary method 400 are shown in FIG. 4.

Figure 5:
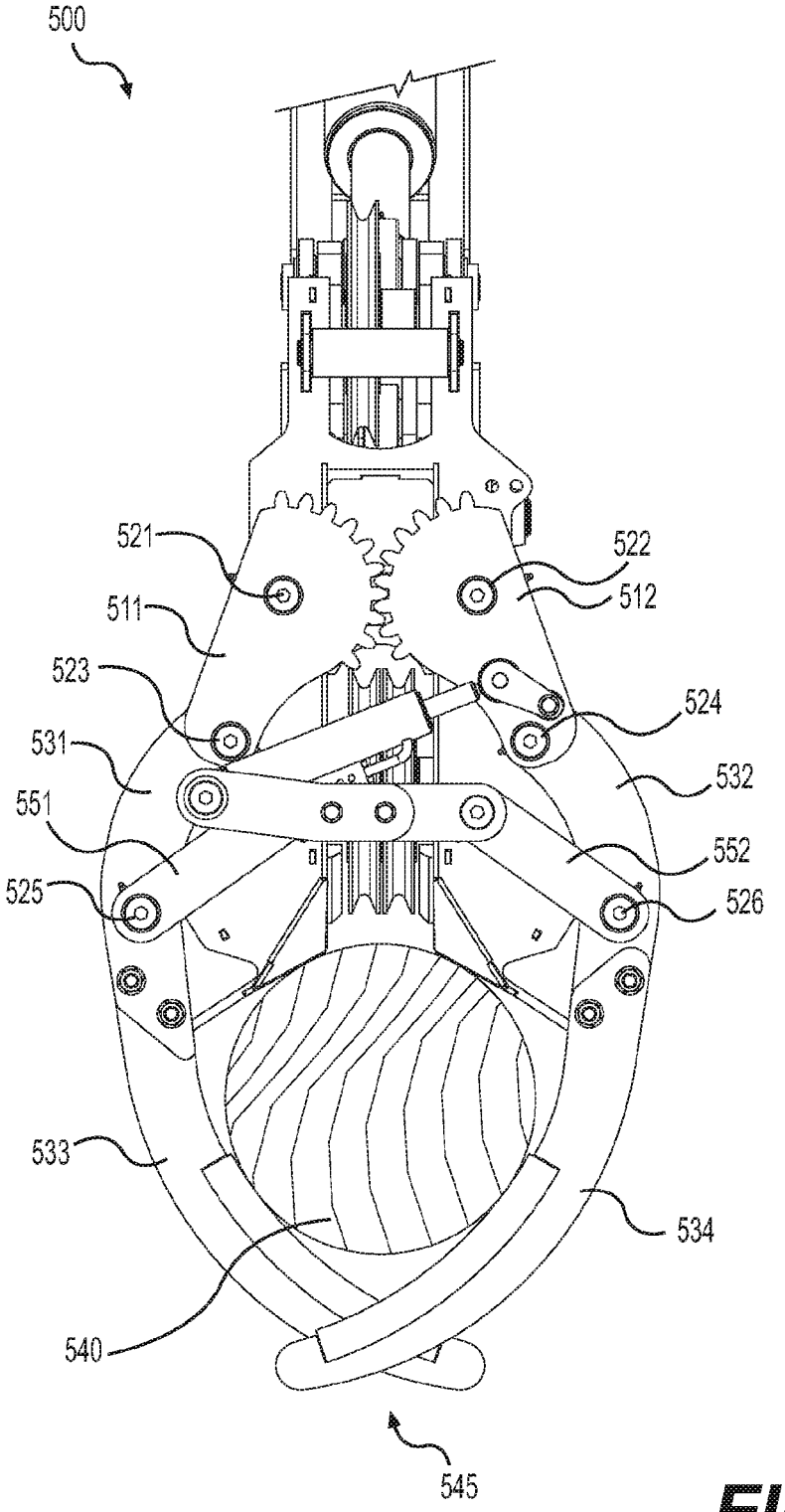
FIG. 5 is a top-down view of an exemplary grappler that may be used in conjunction with the overload protection system of FIG. 1.
Figure 6:
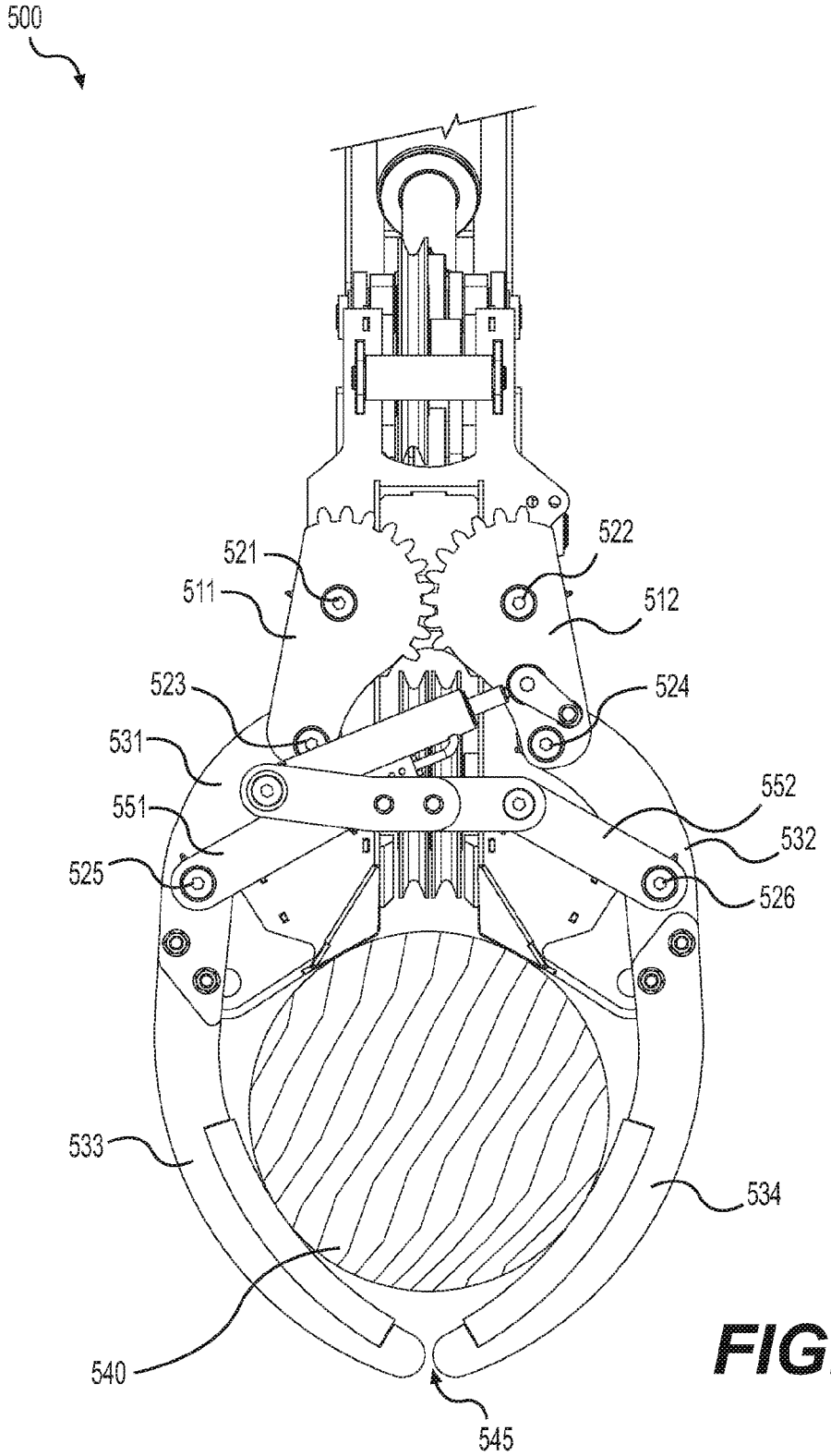
FIG. 6 is another top-down view of the grappler of FIG. 5.

The device 110 may include a tool 112 configured to perform a certain task or function. The tool 112 is mechanically coupled to a base 116, which may be a stationary or mobile support (see FIGS. 2, 3A, and 3B). In certain embodiments, the base 116 is a utility truck, a crane base, an oil rig, an earth-working machine, or a fixed structure. In certain embodiments, the device 110 is an aerial device used to access elevated objects or otherwise difficult to reach items. For example, the device 110 may include a member 114 that is rotatable and extendable. The member is used to extend the reach of the tool 112 for accessing difficult to reach locations. The base 116 is mechanically coupled to a first end of the member 114, and the tool is mechanically coupled to a second end of the member 114, opposite the first end. In an embodiment, the tool 112 is a grappler configured to grab objects such as tree limbs (for cutting) or telephone poles (for placing upright in a hole in the ground). FIGS. 5 and 6 depict exemplary grapplers, as further described below.

The sensor suite 120 includes at least one sensor for measuring aspects of the device 110. For example, a first sensor 122 may include a rotary position sensor configured to measure angular rotation of an axle or shaft. Exemplary rotary position sensors include rotary variable differential transformers (RVDTs), rotary encoders, synchros, resolvers, and potentiometers. The first sensor 122 provides rotational position information related to a component of the device 110 and provides the information to the controller 130. The information may be provided continuously (e.g., via an analog signal) or at regular intervals (e.g., a digital signal at a processor rate). Or, controller 130 may send a request for information from the first sensor 122 at any instance or according to any schedule. Based on information from the first sensor 122, the controller 130 may determine an expected load on the device 110, as further described below. An optional second sensor 124 may include another rotatory position sensor (e.g., either the same or a different type of rotary position sensor as the first sensor 122). Or, optional sensor 124 may be a completely different type of sensor, as further described below.

The controller 130 is for example a computer, microcontroller, microprocessor, or programmable logic controller (PLC) having a memory 134, including a non-transitory medium for storing software 135, and a processor 132 for executing instructions of the software 135. An example of software instructions includes method 400, described below in connection with FIG. 4. The controller 130 may further include an optional interface 136 (depicted with dashed lines in FIG. 1 to indicate that it is optional) for the user to transmit instructions and receive information. The interface 136 may enable a user to input instructions to the device 110 or to receive an alert or indication from the sensor suite 120. Communication between controller 130, device 110, and sensor suite 120 may be by one of a wired and/or wireless communication media. The controller 130 is not limited by the materials from which it is formed or the processing mechanisms employed therein and, as such, may be implemented via semiconductor(s) and/or transistors (e.g., electronic integrated circuits (ICs)), and so forth. It should also be appreciated that the discussed functions and methods performed by the controller 130 may be performed by other processors.

The optional interface 136 may provide a load-indicative alert that informs the operator of the device 110 of an expected overload, as described below in connection with method 400, FIG. 4. The interface 136 may include an alerting mechanism to produce the alert such as a display device, a speaker system, a headphone worn by the operator, light sources, or other similar alerting mechanisms, which may be independent from, or incorporated within, interface 136. In an embodiment, interface 136 includes a hand-held control stick (e.g., a joystick or sidestick controller) for positioning components of the device 110 (e.g., the tool 112 via the member 114) and one or more buttons for operating the tool 112 (e.g., to open/close a grappler).

Figure 2:
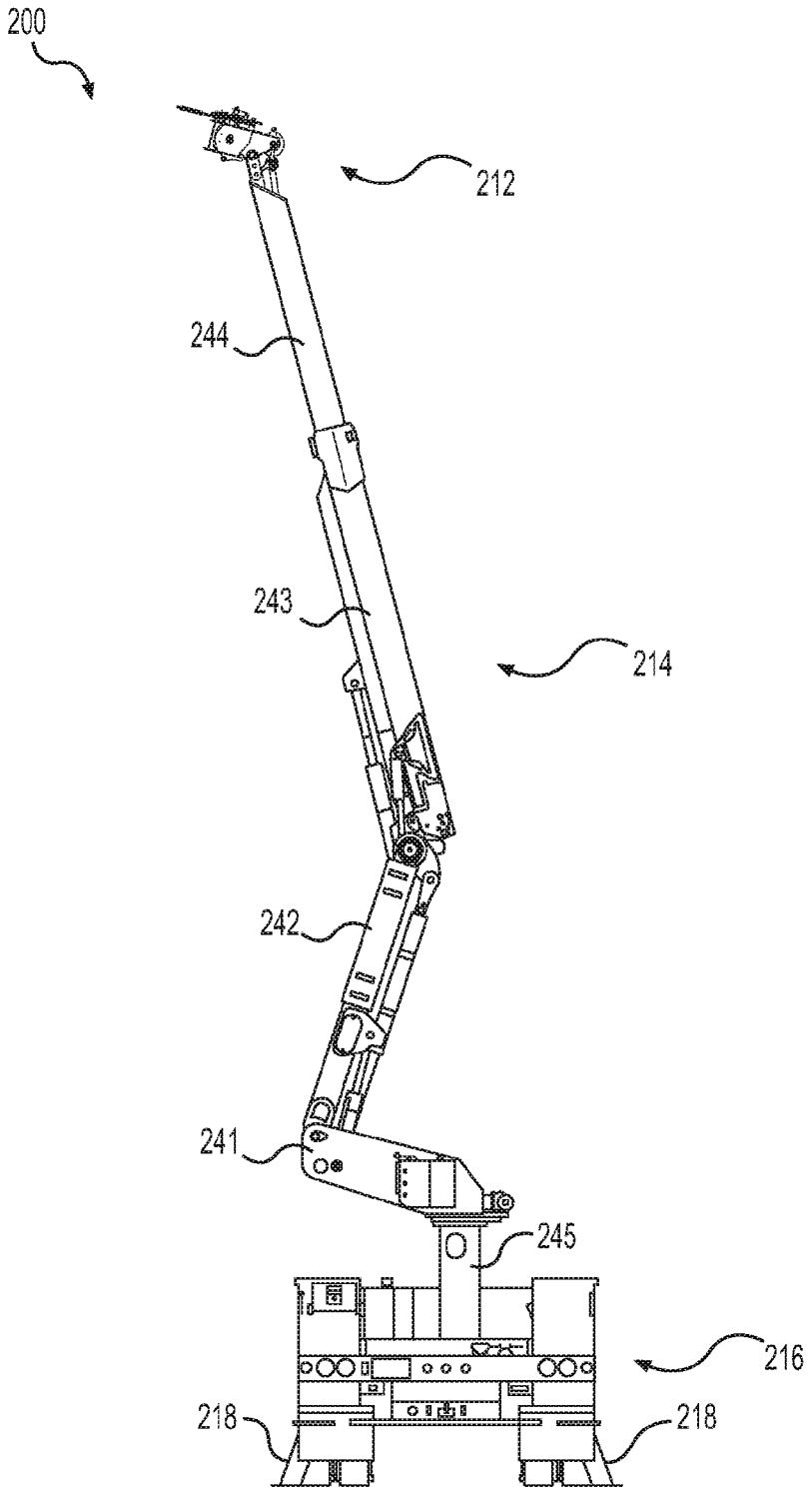
FIG. 2 is a perspective view of an embodiment of a boom with a grappler that may incorporate the overload protection system of FIG. 1.

An aerial device 200, depicted in FIG. 2, is an example of the device 110, FIG. 1. The aerial device 200 generally includes some sort of base that supports an extendable member configured to position a tool. In an embodiment, a utility truck provides a base 216, which is an example of the base 116; a boom 214 serves as the extendable member, which is an example of the member 114; and a grappler 212 serves as the tool, which is an example of the tool 112, FIG. 1. The base 216 provides a stable support, which may include stabilizers 218, for supporting a load applied to the boom 214 and/or the grappler 212. The grappler 212 may rotate to alter its orientation for grabbing objects (e.g., a tree limb oriented horizontally or vertically).

The boom 214 is mechanically coupled to the grappler 212 and configured to support the grappler 212. For extending the reach of the grappler 212, the boom 214 may include more than one section. For example, proximal to the base 216 is a rotatable arm 241, followed by a lower member 242, a middle member 243, and an upper member 244. The grappler 212 is located at the distal end (with respect to the mobile base 216) of the boom 214. The rotatable arm 241 is mechanically coupled to a rotatable shaft 245 mechanically coupled to the base 216. The lower member 242 may pivot from the end of the rotatable arm 241, and the middle member 243 may pivot from an upper end of the lower member 242. Additionally, the upper member 244 may extend from the middle member 243. For example, the upper member 244 may be, at least in part, disposed within the middle member 243, and capable of moving longitudinally within the middle member 243, to extend or retract by "telescoping". The boom 214 may include fewer or a greater number of sections without departing from the scope hereof.

In certain embodiments, the upper member 244 is electrically insulated to enable safe operation nearby electrical power lines. The insulated member may be formed of a non-conductive material, such as a polymer, which may significantly reduce the structural strength of the member compared to members that are not electrically insulated. Accordingly, monitoring the load placed on an insulated member may be performed prevent structural failure. The rotatable and pivotable boom 214 supports the grappler 212 and enables the grappler 212 to reach certain areas and avoid obstacles in the working environment. The boom 214 may fold into a collapsed position (see e.g., FIG. 3A), which enables transporting via the base 216.

Figure 3A:
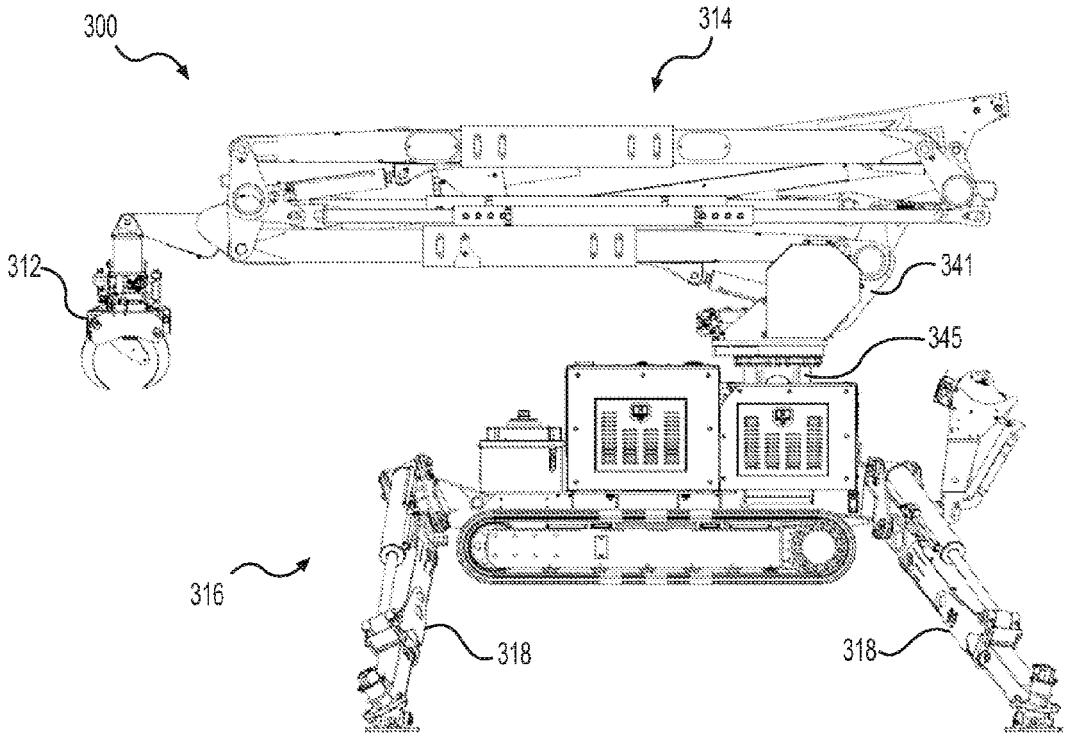
FIG. 3A is a side view of another embodiment of a boom with a grappler that may incorporate the overload protection system of FIG. 1.
Figure 3B:
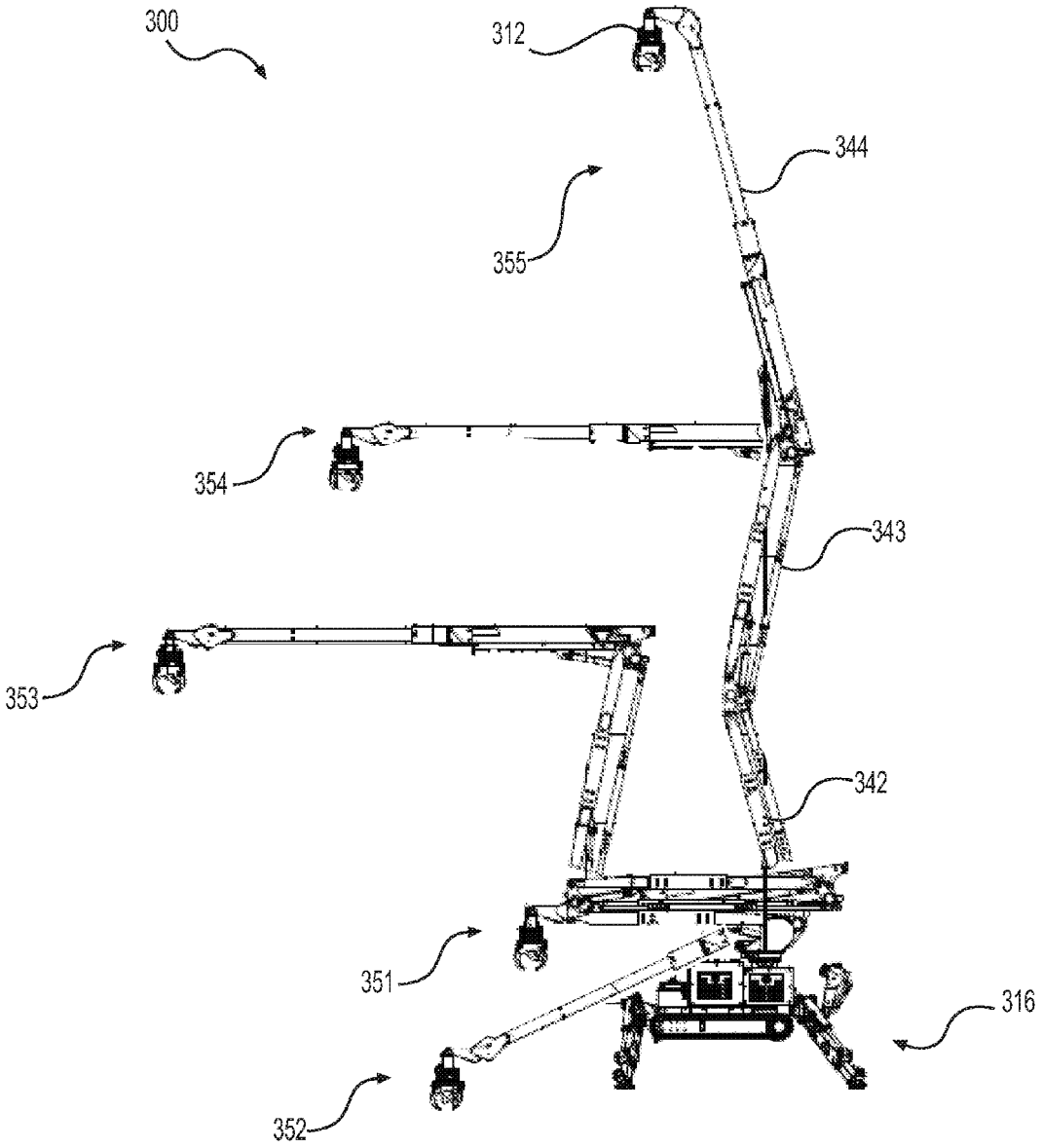
FIG. 3B is a side view of the boom with the grappler of FIG. 3A, with the boom extended in various positions.

An aerial device 300, depicted in FIGS. 3A and 3B, is another example of the device 110, FIG. 1. The aerial vehicle 300 includes a grappler 312, a boom 314, a base 316, stabilizers 318, a rotatable shaft 345, and a rotatable arm 341. FIG. 3A shows the aerial device 300 with the boom 314 in a folded configuration. FIG. 3B shows the aerial device 300 with the lower member 342, the middle member 343, and the upper member 344 of the boom 314 in five exemplary positions: a folded position 351, a downward position 352, a first horizontal position 353, a second horizontal position 354, and an upright position 355. The different positions 351-355 are exemplary only and a myriad of additional positions may also be obtained by rotating, pivoting, and extending members of the boom 314.

The orientation of the boom 314 affects how a load applied to the distal end of the boom (e.g., at the grappler 312) produces torque on the base 316. For example, when the boom 314 is oriented such that the load is not directly above the rotatable shaft 345, the boom 314 acts as a lever arm and the load acts as a force applied to the end of the lever arm causing torque. The amount of torque is proportional to the length of the lever arm and depends on the angle at which the lever arm is oriented. Based on the length of the boom 314 (e.g., depending on the extension of the upper member 344) and the angle of the boom 314 (including the angles of the lower member 342, the middle member 343, and the upper member 344), a load attached to the distal end of the boom 314 applies a torque that could damage the boom or the rotatable shaft 345, or overturn the base 316.

Depending on the orientation of the grappler 312 from the distal end of the upper member 344, the load may also apply a torque on the grappler 312 and the boom 314. For example, if the grappler 312 holds a long object away from its center of gravity, the object may pivot about the position held by the grappler due to its unbalanced weight. In certain embodiments, the grappler 312 is configured to pivot downward upon receiving a load by having a flexible mount to the distal end of the boom 314. This minimizes torque applied to the boom 314 due to the orientation of the grappler 312. For example, when the grappler 312 extends horizontally from the distal end of the boom 314, and grips an object (such as a tree limb), upon transfer of weight to the grappler 312 (e.g., when the limb is severed from the tree), the grappler 312 automatically releases from the horizontal position and swings downward (e.g., to the downward orientation depicted in FIGS. 3A and 3B).

It should be appreciated that, while the above disclosure has been generally directed to the field of grapplers and aerial devices, embodiments of this disclosure may be directed to other fields and uses. For example, embodiments of the overload protection system may be used with a utility bucket attached to the end of the boom 214 and the load includes any people or objects inside the bucket and any objects attached to the bucket.

Various methods of the grappler overload protection system will now be discussed. A flow diagram illustrating steps of an exemplary method 400 of providing grappler overload protection is illustrated in FIG. 4. Broadly, this method determines an expected weight of a load based on the diameter of grappler arms placed about an object; prior to gripping the object, the expected weight is compared to a predetermined limit, and if the limit is exceeded, the method prevents the grappler arms from gripping the object thereby preventing the grappler from bearing an unsafe load. In the steps described below, the controller 130, FIG. 1 performs the various steps, but it should be appreciated that this is only an exemplary embodiment. In other embodiments, other electronic components or a combination thereof may perform any or all of the discussed steps.

In an embodiment, the grappler 212 is configured for holding tree limbs while they are being cut. Operation of the grappler may be by remote control for operator safety. The grappler 212 may be equipped with, or used in conjunction with, cutting shears, such that the grappler 212 grips the tree limb to be cut, the cutting shears cut the limb, and the grappler 212 maintains its grip on the limb to safely lower it to the ground via the boom 214. As the limb is cut, its weight is transferred from the tree to the grappler 212, and this load (e.g., the weight of the limb) is applied to the boom 214.

The grappler 212 may be placed in proximity to the object (e.g., a tree limb). Prior to extending the boom 214, the base 216 may be moved to an appropriate location and stabilized. The boom 214 may be rotated about the rotational shaft 245, and extended upwards and outwards away from the base 216 by pivoting the lower member 242, the middle member 243, the upper member 244, and by extending the upper member 244. Various combinations of these movements may be employed, together with rotating the grappler 212, to position the grappler 212 for gripping the object.

The grappler arms may be placed about the load (e.g., around a tree limb). Exemplary grappler arms are depicted in FIGS. 5 and 6 and described below. The grappler arms may spread apart to accommodate the tree limb, then close around the tree limb to grip it. The grappler arms may just lightly grip the tree limb without transferring any substantial weight to the grappler.

An exemplary grappler 500 is illustrated in FIGS. 5 and 6, which are best viewed together with the following description. Grappler 500 is shown with a cross-sectional view of an object 540, which is for example a tree limb. Grappler 500 further includes a first rotational axis 521 about which a first link element 511 rotates, and a second rotational axis 522 about which a second link element 512 rotates. The first and second link elements 511, 512 rotate in opposite directions in a coordinated manner due to their interlocking toothed edges. The first link element 511 is mechanically coupled to a first grappler arm 531 about a third rotational axis 523, and the second link element 512 is mechanically coupled to a second grappler arm 532 about a fourth rotational axis 524. As depicted in FIG. 5, the first grappler arm 531 may include a removable extension 533, which may be mechanically coupled via bolts for example. Similarly, the second grappler arm 532 may include a removable extension 534 mechanically coupled thereto via bolts. The removable extensions 533, 534 enable the grappler arms to have custom lengths and may include gripping surfaces optimized for a particular function. The opening and closing of first and second grappler arms 531, 532 may be actuated via a gas spring, piston, or the like, mechanically coupled to the grappler arms via linkages. For example, a first linkage 551 is coupled to the first grappler arm 531 via a fifth rotational axis 525, and a second linkage 552 is coupled to the second grappler arm 532 via a sixth rotational axis 526. The first and second linkages 551, 552 provide coordinated movement of both grappler arms simultaneously.

As the first and second grappler arms 531, 532 are opened and closed, the first and second link elements 511 and 512 rotate about the first rotation axis 521 and the second rotational axis 522, respectively. Additionally, the first grappler arm 523 rotates about the third rotational axis 523 and the second grappler arm 532 rotates about the fourth rotational axis 524. A rotary position sensor may be configured to measure the rotary position of any one of the rotational axes 521, 522, 523, 524. Based on one or more of these rotary positions, the spread between the first and second grappler arms 531, 532 may be determined. And by extension, the width of any object gripped within removable extensions 533, 534 may also be determined, as further described below in connection with method 400, FIG. 4.

Returning now to FIG. 4, in a Step 410, a spread of the grappler arms is determined based on information from a first sensor. In an example of Step 410, the controller 130, FIG. 1 receives information from the first sensor 122. The controller 130 may acquire the information actively (e.g., the controller 130 transmits a request to the first sensor 122 to retrieve the information) or the controller 130 may passively receive the information (e.g., the first sensor 122 automatically transmits the information). It should be appreciated that the controller 130 may be acquiring information from numerous different sensors simultaneously or in rapid succession.

In an embodiment, the first sensor 122 is a rotary position sensor configured to measure angular rotation of an axle or shaft. The rotary position sensor may be located about one or more rotational axes of the grappler arms (e.g., rotational axis 521-526, FIGS. 5 and 6). During operation, the grappler arms open and close and the rotary position sensor measures the angle of rotation of a respective rotational axis. Based on the angle of rotation together with the dimensions of the grappler arms 531, 532 and their removable extensions 533, 534, controller 130 determines the spread of the grappler arms 531, 532 and the width of an object therein.

In a Step 420, an expected weight of the load is determined based on the position information from the first sensor. In an example of Step 420, an expected weight of the object 540 is determined based on, at least in part, the rotary position information of rotational axis 521 from the first sensor 122, which may be used to determine the spread of the grappler arms 531, 532, and hence, the width of the object 540. The controller 130 may use some additional knowledge about object 540 in combination with its width to determine its weight. For example, the weight of a tree limb may correlate with its width, such that its weight or a range of possible weights may be determined based on its width. The correlation between weight and width may be stored in memory 134 (e.g., as a lookup table).

A Step 430 is a decision. If in Step 430 the expected weight exceeds a first limit, method 400 proceeds with Step 440 to disable gripping. Otherwise, method 400 proceeds to optional Step 450, described below.

The first limit is a predetermined weight limit for safe operation of the device 110. The controller 130 determines whether the expected weight is above the first limit. In certain embodiments, the controller 130 may compare the expected weight against more than one limit, such as a minimum weight limit, an intermediate weight limit, and an upper weight limit. In certain embodiments, the limit may be predetermined, set, fixed, or variable. As used herein, "limit" means a value, ratio, equation, or other expression. The limit is indicative of certain conditions within the system 100. Other factors may also affect the limit, such as operating temperatures, the type of work being performed, other strains and tasks being performed by the system, and the like. For example, the grappler 212 may be used to grip a tree limb for cutting or a telephone pole for standing upright. For a comparable width of the grappler arms, the expected weight may differ based on the length of the telephone pole versus the length of the tree limb plus any side branches off the main limb. Therefore, in some embodiments, the limit may be determined based upon indications of various operating conditions, including the type of object that constitutes the load. In other embodiments, the limit may be a static, predetermined value, based upon various static and known characteristics of the operating conditions.

If the expected weight is not above the first limit, the steps of method 400 may continue acquiring information from one or more sensors to repeatedly determine an expected weight and compare it against the first limit.

In a Step 440, preventative measures are taken. In an example of Step 440, the controller 130 instructs the device 110 to take preventative measures to avoid damage to system 100, FIG. 1. Preventative measures may include reversing a direction of operation of a component of the device 110, reducing the device 110 speed, stopping the device 110, engaging a clutch to disengage the device 110 (e.g., a grappler and/or cutting mechanism), or other action that may reduce or prevent damage to the device 110. In an embodiment, operation of the grappler 210 is reversed such that the grappler arms are removed from the load. In another embodiment, the grappler 210 is disabled to prevent maintaining a grip on the load with the grappler arms.

In an optional Step 445, an alert is provided to a user. In an example of Step 445, the controller 130 instructs an alerting device (e.g., interface 136) to provide a load-indicative alert. The alert may include audible alarms, audible voices, visual alarms, visible words, or the like (or some combination thereof). In some embodiments, the alert is configured to communicate with a remote, external computer system. The external computer system may be associated with a headquarters location, a maintenance location, a supervisor location, or other location. This allows preventative action to be taken and monitored. The load-indicative alert may distinguish between a relatively low load (for example, a first alert to indicate that caution should be exercised when an expected load approaches the first limit) and a relatively high load (for example, a second alert to indicate an imminent threat when the expected load surpasses the first limit). The first and second alert may be easily distinguishable from one another such that the operator may take appropriate preventative actions to prevent damage to the device 110. For example, the operator may reposition the grappler 212 around a smaller limb to avoid overloading the boom 214, FIG. 2.

In an optional Step 450, an expected torque on a boom is determined. In an example of Step 450, the controller 130 determines an expected torque on member 114, FIG. 1. The expected torque may be based on the expected load (determined in Step 420) in combination with additional information, such as the relative position of the load with respect to the base 116. The additional information may be provided by a sensor, such as the second sensor 124, which may be a sensor configured for determining an angle of the member 114 or a position of the tool 112 with respect to the base 116. The sensor 124 may be a three-axis accelerometer positioned in the distal end of the upper member 344 such that its location may be determined based on movements of the boom 314 from a home position (e.g., the folded position 351, FIG. 3B).

As depicted in FIG. 3B, aerial device 300 may orient boom 314 in various positions, including the folded position 351, the downward position 352, the first horizontal position 353, the second horizontal position 354, and the upright position 355. For any position that orients the load such that it is not directly above the rotatable shaft 345, the boom 314 acts as a lever arm and the load acts as a force applied to the end of the lever arm causing torque. The amount of torque is proportional to the length of the lever arm and the torque also depends upon the angle at which the lever arm is oriented. For example, in first horizontal position 353, the grappler 312 is extended substantially horizontally, and therefore any load held by the grappler 312 is not located directly above the rotatable shaft 345 but is instead a substantial distance off to the side of the base 316. The amount of torque depends on the amount of the load and the distance that the grappler 312 is extended to the side of the base 316, which may be determined via the boom angle. The overall boom angle may depend on the collective angles of each of the boom sections 341-344.

In certain embodiments, the controller 130 may determine the expected torque based on the expected load and the commanded position of the grappler 312, with or without the aid of a sensor (such as optional second sensor 124). In other words, since the controller 130 is used to command movement of the grappler 312 to a desired location, the controller 130 may be configured to determine the grappler 312 location with respect to the base 316 based on the commanded movements.

In some embodiments, the step of determining the expected torque is active, in that the controller 130 samples, retrieves, or otherwise actively acquires the grappler 312 position information and the expected load. In other embodiments, the step of acquiring is passive, in that the controller 130 receives a message, a signal, or some other electronic information that is indicative of the grappler 312 position and the expected load. It should also be appreciated that the controller 130 may be acquiring numerous different load indications, including the expected weight of the load, simultaneously or in rapid succession.

In various embodiments, the controller 130 will be sampling, receiving, or otherwise acquiring load indications occasionally, periodically, continuously, or substantially continuously. Additionally or alternatively, the controller 130 may be sampling, receiving, or otherwise acquiring the load indication only upon the presence of certain conditions. For example, the system 100 may not report load indications while idle.

Returning again to FIG. 4, an optional Step 460 is a decision. If in Step 460 the expected torque exceeds a second limit, method 400 proceeds with Step 440 to take preventative measures. Otherwise, method 400 proceeds to step 470 to grip the load. The controller 130 determines whether the expected torque is above the second limit. In certain embodiments, there may be a plurality of intermediate second limits. For example, the number of intermediate limits could be one, two, four, five, or more. The number of intermediate limits may not be fixed, but may be determined based upon available information from the sensor suite 120.

In a Step 470, gripping the load is enabled. In an example of step 470, the controller 130 has determined that the expected weight of the load, and optionally the expected torque of the load, do not present a threat to damage the system 100. The controller 130 may then enable the tool 112 to perform a function. In an embodiment, the controller 130 enables the grappler 212 to grip a tree limb for cutting.

Although embodiments of this disclosure have been described with reference to the illustrations in the attached drawing figures, it is noted that equivalents may be employed and substitutions made herein without departing from the scope hereof as recited in the claims.

Having thus described various embodiments, what is claimed as new and desired to be protected by Letters Patent includes the following:

1. A grappler overload protection system comprising:
- a grappler having at least two arms for gripping a load;
- a first sensor for providing a first load indication based on a position of the at least two arms while gripping the load; and
- a controller configured to determine whether the first load indication exceeds a first limit for preventing the grappler from bearing an unsafe load.

2. The grappler overload protection system of claim 1, wherein the controller determines a weight of the load based on the first load indication.

3. The grappler overload protection system of claim 1, wherein the first load indication comprises a width of a portion of the load, such that the controller determines the weight of the load based on the width of the load.

4. The grappler overload protection system of claim 3,
- wherein the first sensor comprises a rotary position sensor configured to measure a rotational position of at least one of the grappler arms about its rotational axis, such that the controller determines the width of a portion of the load based on the rotational position of the at least one grappler arm while gripping the portion of the load.

5. The grappler overload protection system of claim 1, further comprising a second sensor for providing a second load indication, wherein the second load indication is indicative of a position of the grappler.

6. The grappler overload protection system of claim 5, further comprising:
- a second limit, wherein the controller is configured to determine whether the second load indication exceeds the second limit for preventing the grappler from bearing an unsafe load.

7. The grappler overload protection system of claim 5, wherein the second load indication comprises:
- an angle of a boom, wherein the boom is mechanically coupled to the grappler for rotating, pivoting, and extending the grappler; and
- a length of the boom,
- wherein the controller determines a torque on the boom based on the angle of the boom and the length of the boom in combination with the weight of the load.

8. The grappler overload protection system of claim 1, further comprising an alerting mechanism configured to alert an operator when the controller determines that at least one of the first load indication exceeds the first limit and the second load indication exceeds the second limit.

9. A grappler overload protection method comprising the following steps:
- determining a spread of the grappler arms based on information from a first sensor;
- estimating an expected weight of the load based on the spread of the grappler arms; and comparing the expected weight to a first limit to prevent the grappler from bearing an unsafe load.

10. The grappler overload protection method of claim 9, further comprising taking preventative measures to prevent a grappler overload when the expected weight exceeds the first limit.

11. The grappler overload protection method of claim 10, further comprising disabling the grappler arms from gripping the load when the expected weight exceeds the first limit.

12. The grappler overload protection method of claim 9, further comprising the following steps:

determining an angle of a boom that supports the grappler; and estimating an expected torque on the boom based on the boom angle and the expected weight of the load.

13. The grappler overload protection method of claim 12, further comprising taking preventative measures to prevent a grappler overload when the expected torque exceeds a second limit.

14. The grappler overload protection method of claim 13, further comprising disabling the grappler arms from gripping the load when the expected torque exceeds the second limit.

15. The grappler overload protection method of claim 13, further comprising gripping the load with the grappler and lowering the load via a boom mechanically coupled to the grappler when the expected weight does not exceed the first limit and the expected torque does not exceed the second limit.

16. A non-transitory computer readable medium having a computer program stored thereon for providing grappler overload protection, wherein the computer program is configured to instruct a processing element to perform the following steps:

determining a spread of grappler arms placed about a load, wherein the spread is based on information from a first sensor;

estimating an expected weight of the load based on the spread of grappler arms placed about the load; and comparing the expected weight to a first limit for preventing the grappler from bearing an unsafe load.

17. The non-transitory computer readable medium of claim 16, further comprising disabling the grappler arms from gripping the load when the expected weight exceeds the first limit.

18. The non-transitory computer readable medium of claim 17, further comprising the following steps:

determining an angle of a boom mechanically coupled to the grappler; and determining an expected torque on the boom based on the boom angle and the expected weight of the load.

19. The non-transitory computer readable medium of claim 18, further comprising disabling the grappler arms from gripping the load when the expected torque exceeds a second limit.

20. The non-transitory computer readable medium of claim 18, further comprising gripping the load with the grappler and lowering the load via the boom when the expected weight does not exceed the first limit and the expected torque does not exceed the second limit.

* * * * *